US010479946B2

(12) United States Patent
Molinari et al.

(10) Patent No.: US 10,479,946 B2
(45) Date of Patent: Nov. 19, 2019

(54) SYSTEM AND PROCESS FOR INCREASING HEAVY OILS CONVERSION CAPACITY

(71) Applicant: Eni S.p.A., Rome (IT)

(72) Inventors: Mario Molinari, San Donato Milanese (IT); Alberto Maria Malandrino, Milan (IT); Susi Bonomi, Milan (IT)

(73) Assignee: Eni S.p.A., Rome (IT)

( * ) Notice: Subject to any disclaimer, the term of this patent is extended or adjusted under 35 U.S.C. 154(b) by 0 days.

(21) Appl. No.: 15/538,684

(22) PCT Filed: Dec. 23, 2015

(86) PCT No.: PCT/IB2015/059911

§ 371 (c)(1),
(2) Date: Jun. 22, 2017

(87) PCT Pub. No.: WO2016/103199

PCT Pub. Date: Jun. 30, 2016

(65) Prior Publication Data

US 2017/0349839 A1 Dec. 7, 2017

(30) Foreign Application Priority Data

Dec. 23, 2014 (IT) ..... MI2014A2220

(51) Int. Cl.

| | |
|---|---|
| ***C10G 45/16*** | (2006.01) |
| ***C10G 45/00*** | (2006.01) |
| ***C10G 47/26*** | (2006.01) |
| ***C10G 49/22*** | (2006.01) |

(52) U.S. Cl.

CPC ..... *C10G 45/00* (2013.01); *C10G 47/26* (2013.01); *C10G 49/22* (2013.01); *C10G 2300/4012* (2013.01); *C10G 2300/4081* (2013.01); *C10G 2300/708* (2013.01)

(58) Field of Classification Search

CPC ..... C10G 45/16; C10G 2300/4006; C10G 2300/4012; B01J 8/0025

See application file for complete search history.

(56) References Cited

U.S. PATENT DOCUMENTS

| | | | | |
|---|---|---|---|---|
| 5,639,798 | A * | 6/1997 | Wilson | B01J 8/22 502/308 |
| 6,436,279 | B1 | 8/2002 | Colyar | |
| 2009/0220389 | A1 * | 9/2009 | Onishi | B01J 8/007 422/146 |
| 2011/0160505 | A1 | 6/2011 | McCall | |

FOREIGN PATENT DOCUMENTS

| | | |
|---|---|---|
| IT | MI2007A1044 | 5/2007 |
| IT | MI2007A1045 | 5/2007 |
| IT | MI2007A1198 | 6/2007 |
| IT | MI2010A1989 | 6/2007 |
| IT | MI2008A1061 | 6/2008 |
| WO | WO2008141831 A1 | 11/2008 |
| WO | WO 2008/151792 A1 | 12/2008 |

OTHER PUBLICATIONS

International Search Report and Written Opinion for PCT/IB2015/059911, dated Feb. 26, 2016, 10 pages.

* cited by examiner

*Primary Examiner* — Randy Boyer
(74) *Attorney, Agent, or Firm* — Praedcere Law

(57) ABSTRACT

System and corresponding process for the hydroconversion of heavy oils essentially comprising a reactor, a liquid-vapor separator and a section for stripping conversion products outside the reactor comprising an inlet conduit for the stripping gases located at a point on the conduit providing a connection between the head of the reactor and the liquid-vapor separator inclined, at least from the point of entry, upwards with a gradient of between 2% and 20%, preferably between 3% and 12%, with respect to a horizontal plane. The inlet conduit for the stripping gases is inclined with respect to the axis of the conduit providing a connection between the reactor head and the liquid-vapor separator through an angle of between 20° and 65°, more preferably between 30° and 60°, even more preferably between 40° and 50°. The stripping gas delivered to the connection conduit between the head of the reactor and the separator flows in a downward direction.

14 Claims, 4 Drawing Sheets

SYSTEM AND PROCESS FOR INCREASING HEAVY OILS CONVERSION CAPACITY

This invention relates to a system and corresponding process for increasing heavy oils conversion capacity.

The hydroconversion of heavy petroleum products can be achieved using different process systems. The core of the technology is the hydroconversion reactor, which may be of the fixed bed, ebullated bed or slurry type. In the latter case the catalyst is dispersed in the reaction medium and is uniformly distributed within the reactor itself.

One EST system (ENI Slurry Technology) (IT-M12007A1044; IT-M12007A1045; IT-MI2007A1198; IT-M12008A1061; IT-M12010A1989) provides for delivering the effluent from the head of the reactor to an HP/HT high pressure/high temperature liquid-vapor separator. The gas leaving the HP/HT separator is passed to a gas treatment section from which a flow rich in hydrogen is recovered and recycled to the reactor, while the liquid passes through a series of vessels at decreasing pressure and temperature (medium pressure separator, atmospheric column and vacuum column) to separate the reaction products and give rise to recycling of the catalyst and the unconverted charge.

If the reaction products are obtained exclusively in the vapor phase (VPO) (Vapor Phase Outflow), the low pressure sections which might bring about the formation of coke outside the reactor can be avoided, even though this results in a decrease in the capacity of the plant.

When catalyst is present and hydrogen is absent, at pressures below the reactor pressure, it has been found by experiment that dehydrogenation reactions leading to the production of hydrogen and coke can take place. High temperature, low pressure and long residence times in the liquid holdups in the vessels can render solids formation outside the reactor of the same order of magnitude as that within the reactor. In addition to this, if the vacuum unit is not sufficiently dimensioned at the design stage the formation of hydrogen at the base of the vacuum column may have a significant impact on the fractionation capacity of the column.

By adopting an EST system according to which the products are obtained only in the vapor phase (VPO), which we will call EST-VPO, the slurry is confined to the zone of high $H_2$ partial pressure, eliminating all the problems associated with dehydrogenation and the formation of solid outside the reactor. Against this advantage the capacity of an EST-VPO plant with direct recycling from the HP/HT separator is significantly lower, for the same reaction temperature, than that of an EST plant with recycling from the vacuum column. The loss of capacity may be compensated by increasing the reaction temperature, even though this results in an increase in the formation of solid within the reactor itself. Feeding a gas with a high $H_2$ concentration (also referred to as "secondary" in order to distinguish it from the "primary" gas of the same composition fed to the reactor) to the connecting line between the reactor and high temperature/high pressure separator is one way of increasing the conversion capacity of an EST-VPO plant on account of the stripping effect of the gas itself.

An EST-VPO system which does not provide for the use of secondary gas has a smaller capacity for the same operating conditions because the liquid leaving the HP/HT separator and recycled to the reactor has the same composition as the liquid leaving the reactor. Using the secondary gas increases the throughput of reaction products leaving the top of the separator. At the same time the composition of the liquid phase recycled to the reactor changes and is again subjected to a hydroconversion reaction, but at this point it is impoverished in lighter components which have passed into the gas phase. Because products only leave from the top of the separator in the EST-VPO system, the increase in their throughput coincides with an increase in the capacity of the plant. It can be demonstrated that the more the liquid recycled to the reactor is similar to that leaving the reactor in terms of composition, the greater the shift towards the formation of light products. In comparison with an EST-VPO system which does not make provision for it, through the effect of the stripping action of the secondary gas the liquid recycled to the reactor will be heavier than that leaving the reactor and as a consequence the quantity of products leaving with the vapor phase will increase, although with a different composition. Feeding gas with a high hydrogen content to the connecting line between the head of the reactor and the high pressure/high temperature HP/HT separator makes it possible to increase the conversion capacity of an EST-VPO system.

The length of line downstream from the secondary gas feed acts as a theoretical liquid/vapor equilibrium stage. The geometry and fluid dynamics of the connecting line are designed to achieve equilibrium between the liquid and vapor in the reactor effluent/secondary gas mixture before entering the separator. Where liquid/vapor equilibrium does not have to be achieved the effect of adding the secondary gas can in the worst of cases be reduced to a mere addition of gas.

While the use of stripping gas to assist release of the components in the gas phase which would normally be confined in the liquid phase and feeding a stripping gas to the connecting line between the head of the reactor and the separator is known (IT-MI2007A1044), no description has been provided as to how the stripping gas should be fed to that line.

The connecting line between the head of the reactor and the separator must be suitably designed in order to achieve liquid/vapor equilibrium in the flow before it enters the separator.

We have now found that a suitable upward inclination of the connecting line between the head of the reactor and the separator is essential for achieving liquid/vapor equilibrium before entering the liquid-vapor separator.

Combining the inclination selected with a suitable insertion of the secondary gas feed line, at a suitable length and/or at a suitable cross-section of the connecting line may also be advisable.

The system for the hydroconversion of heavy oils constituting the subject matter of this invention essentially comprises a reactor, a liquid-vapor separator and a section for stripping conversion products outside the reactor comprising a conduit for feeding stripping gases located in such a way that the said gas feed takes place at a point in a connection conduit between the head of the reactor and the liquid-vapor separator in which the said connection conduit is upwardly inclined, at least from the feed point, with a gradient of between 2% and 20%, preferably between 3% and 12%.

With the line suitably upwardly inclined, within a specific range of gas/liquid throughputs leaving the reactor, a stratified wavy flow regime is set up, in which suitable remixing between the phases takes place from the point at which the secondary gas is fed in. The establishment of a stratified wavy flow regime makes possible the continuous renewal of the surface of the liquid in contact with the gas, thus increasing the efficiency of material exchange.

It is recommended that the stripping gas feed conduit should be inclined with respect to the axis of the connection conduit between the head of the reactor and the liquid-vapor separator at an angle of between 20° and 65°, more preferably between 30° and 60°, even more preferably between 40° and 50°. It is also advisable that the stripping gas flow should preferably occur in a downward direction.

It is also preferable that the said feed conduit, with the angles of inclination recommended above, should lie in the vertical plane passing through the axis of the connection conduit. Preferably the cross-section (A) of the conduit providing the connection between the head of the reactor and the liquid-vapor separator and the length (L) of the portion of that conduit between the point of entry for the stripping gases and the point of entry to the separator satisfy the following relationships:

$$(A\times L)(Q_V+Q_{Vsec}+Q_L)>10 \text{ s, more preferably } >15 \text{ s,}$$

$$(Q_V+Q_L)/A>0.5 \text{ m/s, more preferably } >1 \text{ m/s,}$$

$$2>Q_{Vsec}/Q_v>0.25, \text{ more preferably } 1>Q_{Vsec}/Q_V>0.5$$

where $Q_V$ and $Q_L$ are the volumetric throughputs of vapor and slurry (liquid+solid) leaving the head of the reactor and $Q_{Vsec}$ is the volumetric throughput of secondary gas. One embodiment of conduit (T) connecting the head of the reactor to the liquid-vapor separator and conduit (I) for the entry of stripping gas is illustrated in FIG. 1.

The flow of gas and slurry (1) leaving the reactor enters at point (B) on the conduit (T) and undergoes stripping in the portion between point (C) and point (F) by means of the gases entering through entry conduit (I) inclined at an angle of between 20° and 65° with respect to the axis of conduit (T). The section of conduit (T) to which the entry conduit is inserted is inclined upwards with a gradient of between 2% to 20% with respect to a horizontal plane. The flow of gas and slurry which has been stripped finally exits at point (F) to enter the separator.

The length (L) of section of conduit (T) extends from the point of entry for the stripping gas as far as the point of entry to the separator (from point (C) to point (F) in FIG. 1, passing through points (D) and (E)).

Obstacles of suitable geometry which assist intimate remixing of the liquid and vapor phase and allow liquid/vapor equilibrium to be achieved may be inserted within the conduit connecting the head of the reactor to the entry to the separator.

It is recommended that the said obstacles be inserted along the top wall within the said conduit providing a connection between the head of the reactor and the liquid-vapor separator in such a way as to cause the gas to thread its way beneath the liquid thus bringing about adequate remixing and at the same time avoiding any accumulation of solid behind the obstacle, which may occur all the more so because of the positive gradient of the conduit. This embodiment is illustrated in FIG. 2, where with an obstacle (G) located:

- along the lower wall of conduit (T) problems may occur with the accumulation of solids (AS) (FIG. 2*a*);
- along the upper wall of conduit (T) the solids remain dispersed (DS) (FIG. 2*b*).

The system applies to all types of reactors in which the outflow comprises a two-phase LN flow, also including a flow obtained from the merging of at least one liquid flow and at least one vapor flow leaving the reactor, including fixed bed reactors which might contain dispersed solids, slurry reactors, preferably a slurry bubble column, and ebullated bed reactors.

A further object of this invention is the process for the hydroconversion of heavy oils carried out using the system according to the invention.

The said process for the hydroconversion of heavy oils comprises sending the heavy oil to a hydrotreatment stage performed in a reactor with a suitable hydrogenation catalyst, into which reactor hydrogen or a mixture of hydrogen and light hydrocarbons are delivered, performing a stripping stage with a suitable stripping gas on the liquid and vapor flow leaving the reactor, or on the flow obtained from the merging of at least one liquid flow and at least one vapor flow leaving the reactor, passing the said flow to a liquid-vapor separation in a suitable separator separating the liquid phase, which is recycled to the reactor, less purges, from the vapor phase containing the conversion products, the said stripping stage being performed by means of a conduit delivering stripping gas positioned at a point on the conduit connecting the head of the reactor and the liquid-vapor separator and characterized in that the said connection conduit is inclined upwards with a gradient of between 2% and 20%, preferably between 3% and 12%, at least from the point of entry. The process claimed is particularly recommended in the case of the stage of hydrotreatment performed in a reactor with a slurry phase hydrogenation catalyst, preferably selected from a bubble column or a ebullated bed reactor.

When carried out using a slurry phase reactor it is also recommended that it should be operated with a volumetric ratio at the outlet from the reactor of:

vapor flow rate ($Q_V$)(vapor flow rate ($Q_V$)+slurry flow rate ($Q_L$))

of more than 0.75, preferably more than 0.85, where the slurry comprises liquid plus solid.

The cross section (A) of the connection conduit between the head of the reactor and the liquid-vapor separator and the length (L) of the section of the said conduit from the point of entry for the stripping gases to the point of entry to the separator (from point (C) to point (F) in FIG. 1) preferably satisfies the following relationships:

$$(A\times L)(Q_V+Q_{Vsec}+Q_L)>10 \text{ s, more preferably } >15 \text{ s,}$$

$$(Q_V+Q_L)/A>0.5 \text{ m/s, more preferably } >1 \text{ m/s,}$$

$$2>Q_{Vsec}/Q_V>0.25, \text{ more preferably } 1>Q_{Vsec}/Q_V>0.5$$

where $Q_{Vsec}$ is the volumetric throughput of the secondary gas.

The hydrotreatment stage is preferably performed at a temperature of between 400 and 450° C. and a pressure of between 100 and 200 atm.

The hydrogenation catalyst is preferably based on Mo or W sulfide.

Further details may be found in the abovementioned application IT-M12007A1198.

In order that the invention be better defined some examples demonstrating the effectiveness of using secondary gas in the process embodiment according to the invention leading to the acquisition of products in the gas phase (VPO) are described.

EXAMPLES

As already mentioned previously, a change from the EST system (with conversion products in the liquid phase and the presence of low pressure sections) to an EST-VPO system (in which the products leave only in the gas phase) results in a drastic reduction in the potential capacity of the plant. In order to overcome this the reaction temperature must be increased and secondary gas must be used because in the absence of the latter the potential capacity of the plant, other operating conditions being equal, is in any event reduced by approximately 20% in comparison with the EST reference case.

Figure 1:
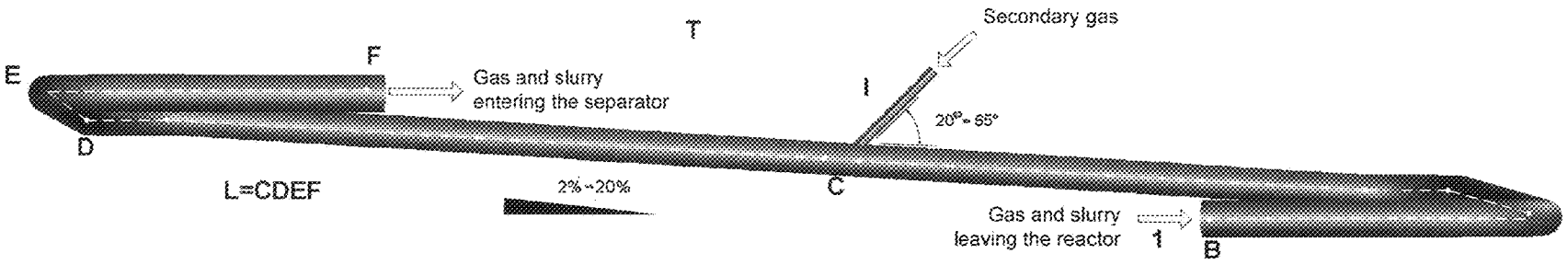
FIG. 1 is an illustration of an embodiment of conduit T connecting the head of the reactor to the liquid-vapor separator and conduit I feeding the stripping gases.
Figure 2:
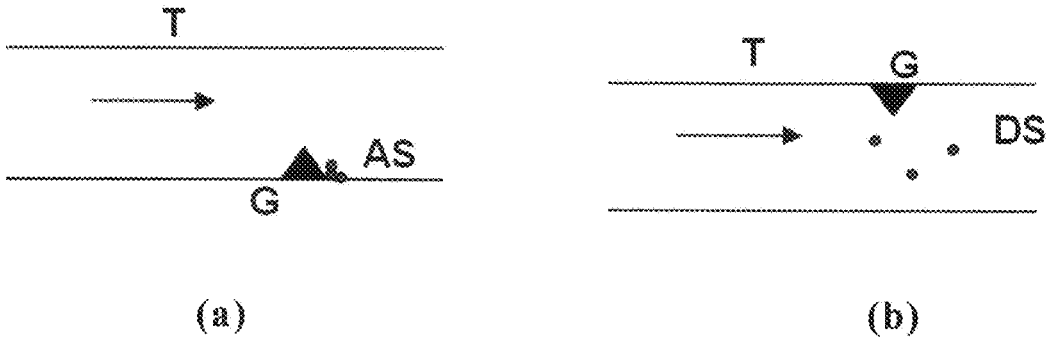
FIG. 2 illustrates an embodiment were an obstacle G is located along the lower wall of the conduit (FIG. 2*a*) in which case problems occur with accumulation of solids AS, and where an obstacle G is located along the upper wall of the conduit T in which case solids remain dispersed DS (FIG. 2*b*).

The embodiment of conduit (T) connecting the head of the reactor to the liquid-vapor separator and conduit (I) feeding the stripping gases is that already illustrated in FIG. 1, in which:

- the section of conduit connecting the point of entry for the secondary gas to point (D) is inclined upwards with a gradient of 6%;
- the entry conduit for the stripping gases is inclined with respect to the axis of the conduit connecting the head of the reactor to the liquid-vapor separator by an angle of 45° ;
- the flow of stripping gas fed to the connection conduit between the head of the reactor and the separator takes place in a downward direction, in the vertical plane passing through the axis of the connection conduit.

Bearing in mind that the flow rate of secondary gas ($W_{sec}$) varies between 0 and 100, where 0 corresponds to the absence of secondary gas whereas 100 indicates that the flow of secondary gas is capable of ensuring the same potential capacity of a plant using an EST system , ($W_{sec}^{EST}$). although operating at a higher reaction temperature, the increase in plant capacity and percentage terms as the secondary gas is varied is shown in Table 1.

TABLE 1

| $(W_{sec}/W_{sec}^{EST}) \times 100$ | Increase in fresh charge |
|---|---|
| 0 | — |
| 10 | 3.4% |
| 20 | 6.3% |
| 30 | 8.9% |
| 40 | 11.1% |
| 50 | 13.1% |
| 60 | 14.8% |
| 70 | 16.3% |
| 80 | 17.7% |
| 90 | 18.9% |
| 100 | 20.1% |

Thus, for example using 50% of the throughput of secondary gas required to achieve the potential capacity of an EST system plant (although operating at higher temperature) there is an increase of 13.1% in fresh charge.

Figure 3:
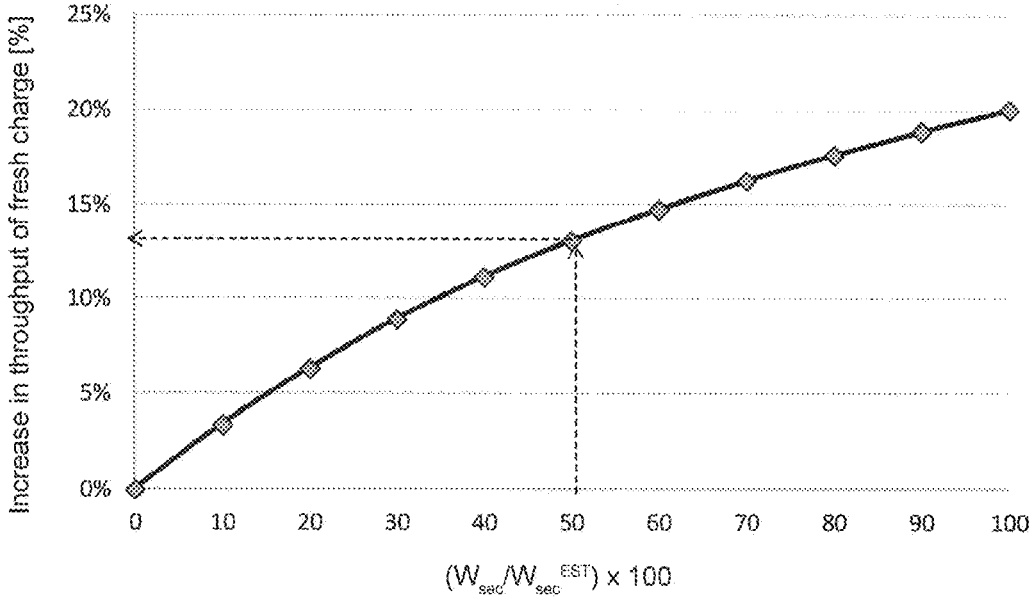
FIG. 3 graphically shows the effect of secondary gas on the throughput of fresh charge in terms of percentage increase.
Figure 4:
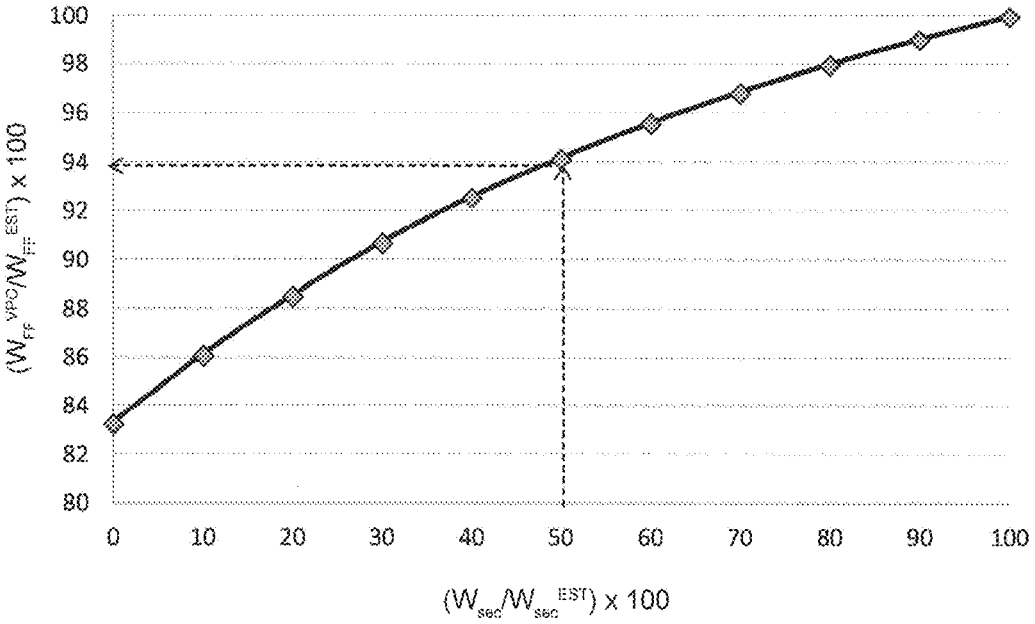
FIG. 4 graphically shows the effect of secondary gas on the increase in the capacity of an EST-VPO plant ($W_{FF}^{VPO}$) operated at higher temperature, compared to the potential capacity of an EST ($W_{FF}^{EST}$).

The effect of secondary gas on the throughput of fresh charge in terms of percentage increase can be displayed by graphically illustrating what is set out in the table (FIG. 3). FIG. 4 also shows the effect of secondary gas on the increase in the capacity of an EST-VPO plant ($W_{FF}^{VPO}$) operated at higher temperature, in comparison with the potential capacity of an EST ($W_{FF}^{EST}$). In the latter case, using 50% of the flow rate of secondary gas the potential capacity of the plant achieves 94% of the maximum throughput which can be obtained in accordance with the above definition.

The stripping effect of the secondary gas has the result that products which are "heavier" in comparison with the situation in which it is not used leave the plant, but the benefit achieved in terms of productivity is appreciable. The different quality of the products obtained can be assessed by analysing the percentage increase in Diesel, Naphtha and VGO products as a function of the ($W_{sec}/W_{sec}^{EST}$) ratio expressed in percentage terms relative to the secondary gas as shown in Table 2.

TABLE 2

Increase in products as the Secondary Gas varies

| $(W_{sec}/W_{sec}^{EST}) \times 100$ | Diesel | Naphtha | VGO |
|---|---|---|---|
| 0 | — | — | — |
| 10 | 2.9% | 2.9% | 6.8% |
| 20 | 5.4% | 5.3% | 12.8% |
| 30 | 7.6% | 7.4% | 18.1% |
| 40 | 9.5% | 9.1% | 22.7% |
| 50 | 11.2% | 10.5% | 26.8% |
| 60 | 12.7% | 11.6% | 30.4% |
| 70 | 14.0% | 12.7% | 33.8% |
| 80 | 15.2% | 13.5% | 36.9% |
| 90 | 16.3% | 14.3% | 39.8% |
| 100 | 17.3% | 15.0% | 42.5% |

Figure 5:
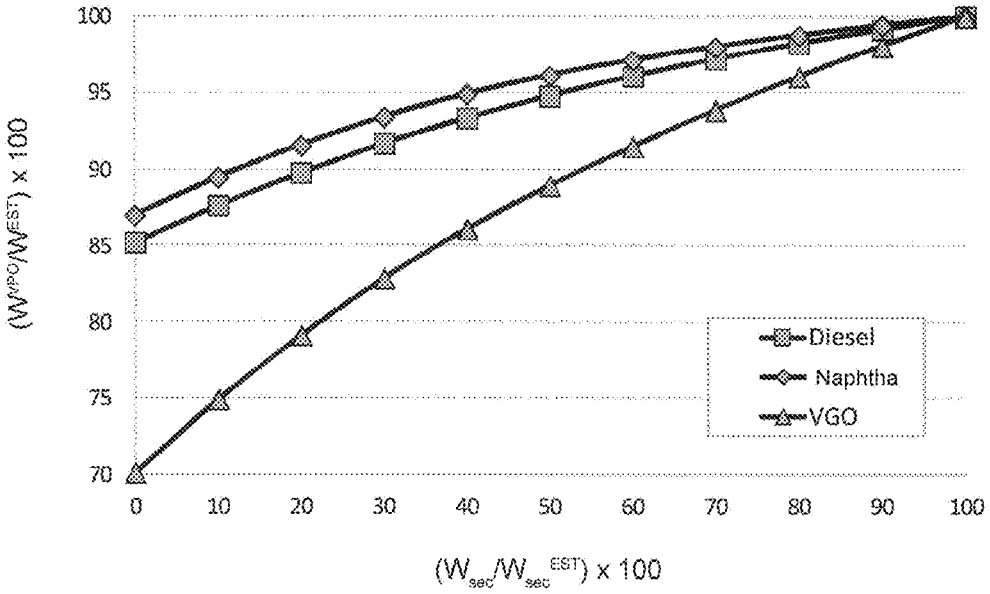
FIG. 5 shows the effect of the overall increase on the three products of interest which comprises the change in the throughput of products in relation to the ($Wsec/Wsec^{EST}$)× 100 ratio of secondary gas in percentage terms.

Here again, if 50% of the throughput of secondary gas is considered, the effect achieved is increases of 11.2%, 10.5% and 26.8% in Diesel, Naphtha and VGO respectively. The effect of the overall increase on the three products of interest is also shown in FIG. 5 which comprises the change in the throughput of products in relation to the ($W_{sec}/W_{sec}^{EST}$) X 100 ratio of secondary gas in percentage terms.

Figure 6:
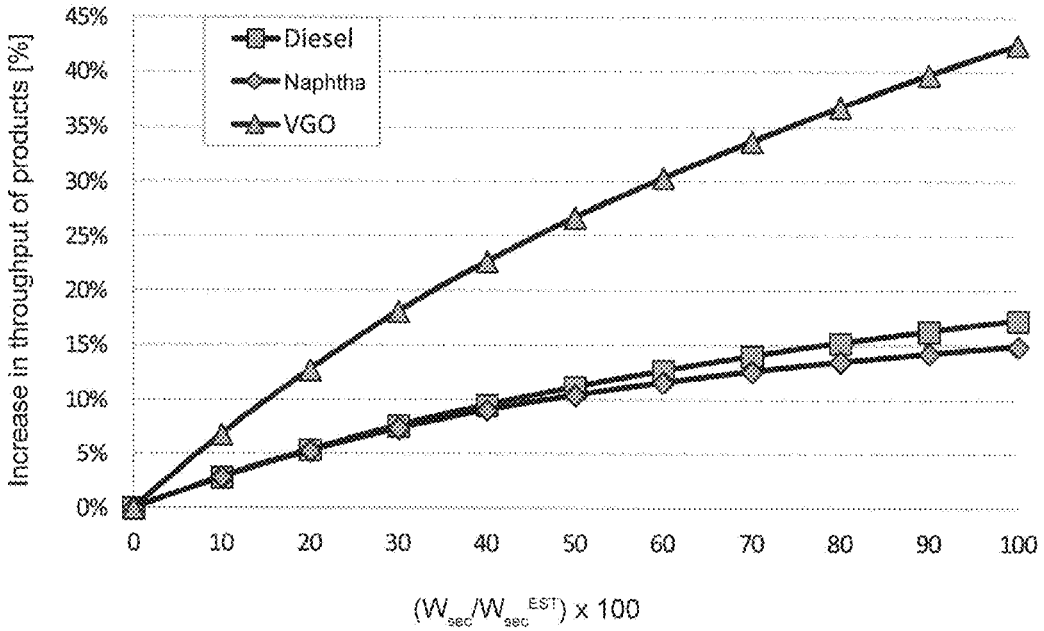
FIG. 6 shows that with 50% of secondary gas, 94%, 96% and 89% of the maximum throughput for Diesel, Naphtha and VGO, respectively can be achieved.

Also, with 50% of secondary gas as defined above, 94%, 96% and 89% of the maximum throughput which can be achieved for Diesel, Naphtha and VGO respectively are achieved (FIG. 6).

As may be seen, the secondary gas has a greater influence on the VGO leaving the plant in comparison with Diesel and Naphtha, an indication that the stripping effect is effective in displacing even rather heavy compounds towards the gas phase.

Figure 7:
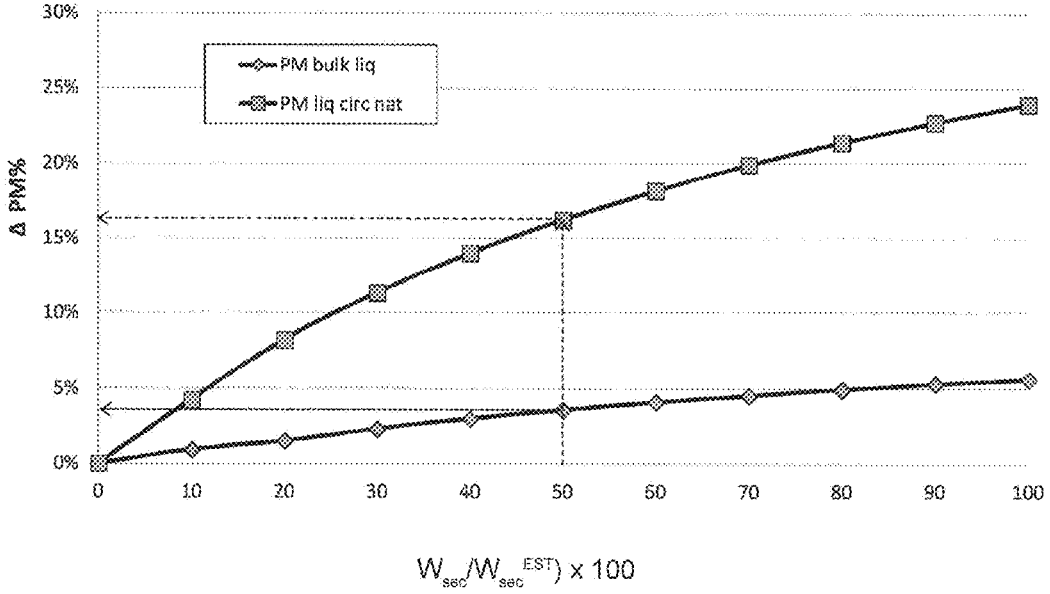
FIG. 7 shows the change in MW of the two liquid flows as the secondary gas ($Wsec/Wsec^{EST}$), both expressed in percentage terms, is varied.

It has already been pointed out that in comparison with an EST-VPO system without the use of secondary gas the liquid recycled to the reactor is heavier than that leaving the reactor itself as a result of the stripping action of the gas. In fact, when the molecular weight of the liquid phase leaving the HP separator recycled to the reactor is monitored in comparison with the molecular weight of the liquid phase leaving the head of the reactor, as the secondary gas increases it is observed that the two flows have an increasingly marked difference in terms of composition and therefore molecular weight. In the absence of secondary gas the molecular weights (MW) of the two liquid phases are identical, but as the throughput of secondary gas is increased the lighter compounds present in the liquid phase pass into the products which then leave the plant in the gas phase, while the liquid phase becomes increasingly heavier. With 50% of secondary gas, according to the definition given above, the molecular weights of the two flows differ by 11%. FIG. 7 shows the change in MW of the two liquid flows as the secondary gas ($W_{sec}/W_{sec}^{EST}$), both expressed in percentage terms, is varied.

The invention claimed is:

1. A system for heavy oils hydroconversion comprising:

a reactor, a liquid-vapor separator, and a stripping section of conversion products, external to said reactor, comprising a connection conduit between a reactor head of said reactor and said liquid-vapor separator and a supply conduit for supplying stripping gas at a point of said connection conduit, wherein said connection conduit is upwardly inclined, at least from the point of supply of the stripping gas, with a gradient of between 2% and 20% with respect to a horizontal plane, wherein obstacles are inserted inside said connection conduit between said reactor head and said liquid-vapor separator, which facilitates intimate mixing of the liquid and vapor phases and makes it possible for liquid/vapor equilibrium to be achieved.

2. The system according to claim 1, wherein said supply conduit of the stripping gas is inclined to the axis of said connection conduit between said reactor head and said liquid-vapor separator at an angle of between 20° and 65°.

3. The system according to claim 1, wherein the stripping gas flow entering said connection conduit between said reactor head and said liquid-vapor separator is in a downward direction.

4. The system according to claim 1, wherein said supply conduit lies in the vertical plane passing through the axis of said connection conduit.

5. The system according to claim 1 wherein said reactor is a bubble column or ebullated bed reactor.

6. The system according to claim 1, wherein said connection conduit between said reactor head and said liquid-vapor separator, at least from the point of supply of the stripping gas, is inclined upward with a gradient of between 3% and 12%.

7. A process for heavy oils hydroconversion comprising providing the system according to claim 1, passing the heavy oil to a hydrotreatment stage carried out in said reactor with a hydrogenation catalyst, to which hydrogen or a mixture of hydrogen and light hydrocarbons are fed, wherein the hydrotreatment stage is conducted at a temperature between 400 and 450° C. and at a pressure of between 100 and 200 atm, performing a step of stripping with said stripping gas on the flow of liquid and vapor phase leaving said reactor, or on the flow obtained merging at least one liquid flow and at least one vapor flow leaving said reactor, passing said flow to liquid-vapor separation in said liquid-vapor separator separating the recycled liquid phase to said reactor, apart from purges, from the vapor phase containing the conversion products obtained only in the vapor phase, wherein said stripping step is carried out by feeding said stripping gas along said supply conduit at the point of supply of the stripping gas and in said connection conduit between said reactor head and said liquid-vapor separator, which is inclined upwards, at least from the point of supply of the stripping gas, with the gradient of between 2% and 20% with respect to a horizontal plane.

8. The process according to claim 7, wherein the hydrotreatment step is carried out in said reactor with a hydrogenation catalyst in slurry phase.

9. The process according to claim 8, wherein at the exit from said reactor the volumetric ratio:

$$\frac{\text{vapor flow rate } (Q_V)}{(\text{vapor flow rate } (Q_V) + \text{slurry flow rate } (Q_L))}$$

vapor flow rate ($Q_V$)/(vapor flow rate ($Q_V$) +slurry flow rate ($Q_L$)) is greater than 0.75, where the slurry comprises the liquid plus solid.

10. The process according to claim 7, wherein said supply conduit for supplying the stripping gas is inclined with respect to the axis of said connection conduit between said reactor head and said liquid-vapor separator at an angle of between 20° and 65° and supplying the stripping gas downwardly along said supply conduit to said connection conduit.

11. The process according to claim 7, wherein the cross section (A) of said connection conduit between said reactor head and said liquid-vapor separator and the length (L) of the section of said connection conduit from the point of supply of the stripping gas to said liquid-vapor separator point of entry satisfy the following relationships $$(A \times L)(Q_V + Q_{Vsec} + Q_L) > 10\text{s}$$

$$(Q_V + Q_L)/A > 0.5\text{m/s}$$

$$2 > Q_{Vsec}/Q_V > 0.25$$

where $Q_V$ and $Q_L$ are the volumetric flows of vapor and slurry (liquid+solid) leaving said reactor head and the volumetric flow rate of the secondary gas $Q_{Vsec}$.

12. The process according to claim 7, wherein the cross section (A) of said connection conduit between said reactor head and said liquid-vapor separator and the length (L) of the section of said connection conduit from the point of supply of the stripping gas to said liquid-vapor separator point of entry satisfy the following relationships $$(A \times L)(Q_V + Q_{Vsec} + Q_L) > 15\text{ s}$$

$$(Q_V + Q_L)/A > 1\text{ m/s}$$

$$1 > Q_{Vsec}/Q_V > 0.5$$

where $Q_V$ and $Q_L$ are the volumetric flows of vapor and slurry (liquid+solid) leaving said reactor head and the volumetric flow rate of the secondary gas $Q_{Vsec}$.

13. The process according to claim 7, wherein the hydrogenation catalyst is based on Mo or W sulfide.

14. A process for heavy oils hydroconversion comprising providing the system according to claim 1, passing the heavy oil to a hydrotreatment stage carried out in said reactor with a hydrogenation catalyst, to which hydrogen or a mixture of hydrogen and light hydrocarbons are fed, wherein the hydrotreatment stage is conducted at a temperature between 400 and 450° C. and at a pressure of between 100 and 200 atm, performing a step of stripping with said stripping gas on the flow of liquid and vapor phase leaving said reactor, or on the flow obtained merging at least one liquid flow and at least one vapor flow leaving said reactor, passing said flow to liquid-vapor separation in said liquid-vapor separator separating the recycled liquid phase to said reactor, apart from purges, from the vapor phase containing the conversion products obtained only in the vapor phase, and wherein said stripping step is carried out by feeding said stripping gas along said supply conduit at the point of supply of the stripping gas and in said connection conduit between said reactor head and said liquid-vapor separator, which is inclined upwards, at least from the point of supply of the stripping gas, with the gradient of between 2% and 20% with respect to a horizontal plane.

* * * * *